US006623137B1

(12) United States Patent
Marsonette

(10) Patent No.: US 6,623,137 B1
(45) Date of Patent: Sep. 23, 2003

(54) LIGHTING SYSTEM

(75) Inventor: Wayne Marsonette, Eugene, OR (US)

(73) Assignee: Marsonette, Inc., Eugene, OR (US)

( * ) Notice: Subject to any disclaimer, the term of this patent is extended or adjusted under 35 U.S.C. 154(b) by 0 days.

(21) Appl. No.: 10/233,228

(22) Filed: Aug. 30, 2002

(51) Int. Cl.[7] ..... F21V 7/04
(52) U.S. Cl. ..... 362/145; 52/200; 362/147
(58) Field of Search ..... 52/200; 385/100; 362/576, 145, 147

(56) References Cited

U.S. PATENT DOCUMENTS

| | | | | |
|---|---|---|---|---|
| 3,788,013 A | | 1/1974 | Veen, Jr. | 52/1 |
| 3,904,866 A | | 9/1975 | Hayes | 240/10 L |
| 4,559,925 A | | 12/1985 | Snow | 126/430 |
| 4,577,619 A | | 3/1986 | Howe, Jr. | 126/431 |
| 4,593,976 A | | 6/1986 | Eijadi et al. | 350/260 |
| 4,630,892 A | | 12/1986 | Howard | 350/264 |
| 4,706,649 A | | 11/1987 | Hager | |
| 5,285,315 A | | 2/1994 | Stiles | |
| 5,408,795 A | | 4/1995 | Eijadi et al. | |
| 5,617,682 A | | 4/1997 | Christopher | 52/200 |
| 6,105,318 A | | 8/2000 | Harrison | 52/200 |
| 6,142,645 A | * | 11/2000 | Han | 362/147 |
| 6,178,707 B1 | * | 1/2001 | Bengtson | 52/200 |
| 6,256,947 B1 | * | 7/2001 | Grubb | 52/200 |
| 6,502,950 B2 | * | 1/2003 | Signer | 362/147 |
| 2001/0013207 A1 | | 8/2001 | O'Neill | 52/200 |

FOREIGN PATENT DOCUMENTS

| | | |
|---|---|---|
| CA | 2253024 | 10/1998 |
| DE | 3832921 | 10/1988 |

* cited by examiner

*Primary Examiner*—Laura K. Tso
(74) *Attorney, Agent, or Firm*—Chernoff, Vilhauer, McClung & Stenzel, LLP

(57) ABSTRACT

Light is transferred through a wall separating a light source from a space to be lighted by an internally reflecting, curved planar mirror. The mirror includes closed curve length that extends through the wall from the space to the lighted and an open curve length that projects from the wall to gather light from the source.

20 Claims, 2 Drawing Sheets

LIGHTING SYSTEM

CROSS-REFERENCE TO RELATED APPLICATIONS

Not applicable.

BACKGROUND OF THE INVENTION

The present invention relates to an apparatus for illuminating an interior space by transferring light from a source through a wall.

Since the advent of the electric light bulb and readily available electric power, most buildings have been designed with the assumption that interior spaces will be illuminated by artificial lights. However, this assumption has been challenged for several reasons. First, the broader spectrum of natural sunlight is better suited to visual tasks. In addition, natural lighting provides more balanced color which is aesthetically pleasing. Further, reducing the use of artificial lights can substantially reduce energy consumption. Not only is energy consumption reduced by an amount necessary to produce the required illumination but the amount of heat released into the interior space can also be substantially reduced, reducing the consumption of energy for cooling.

The use of windows and skylights to provide ventilation and admit natural heat and light to interior spaces of buildings is an ancient practice. While windows and skylights facilitate the entry of natural light and heat, they also have several disadvantages and limitations. Skylights are only practical if there is access to the roof from the interior space. Further, skylights typically require complex roof framing and construction of a tunnel for light to pass from the roof to the ceiling of the interior space. In addition, sky lights are prone to water leakage.

A window permits light and heat to be transferred through a vertical wall into an interior space. Like skylights, windows require special framing around the opening in the wall and altering the framing to add or enlarge a window in a wall of an existing structure can be expensive or impractical. In addition, the efficiency of windows is fairly low. Windows permit light striking the vertical plane of the wall, either transmitted directly from the source or reflected from the environment, to transit the wall. Since windows do not concentrate the light, a substantial window area is required to provide good illumination. In addition to complicating construction, a large window area results in substantial heat gain and loss to the interior space. Higher thermal efficiency can be obtained with complex windows having several layers of specially coated glass separated by a special gas. However, these windows are expensive and difficult to install.

Several devices have been developed to-enhance the solar illumination performance of windows. For example, Eijadi et al., U.S. Pat. No. 4,593,976 discloses a solar illumination device comprising a pair of convex mirrors arranged on the outside of a wall that collect and focus light on a vertical window. In addition, Howard, U.S. Pat. No. 4, 630,892, discloses a device that may be mounted on a wall or a roof of a building to track the sunlight and project it through a window into the structure. These devices increase the amount of sunlight transferred to the interior space through a window by concentrating solar energy on the window. However, the light is still transferred into the interior space through a window subject to the limitations and disadvantage of conventional windows. For example, the special framing required for the window opening may make adding a window or increasing the size of a window expensive or impractical.

What is desired, therefore, is a compact, easily installed system for directing light from a light source through a wall to illuminate an interior space.

DETAILED DESCRIPTION OF THE INVENTION

Figure 1:
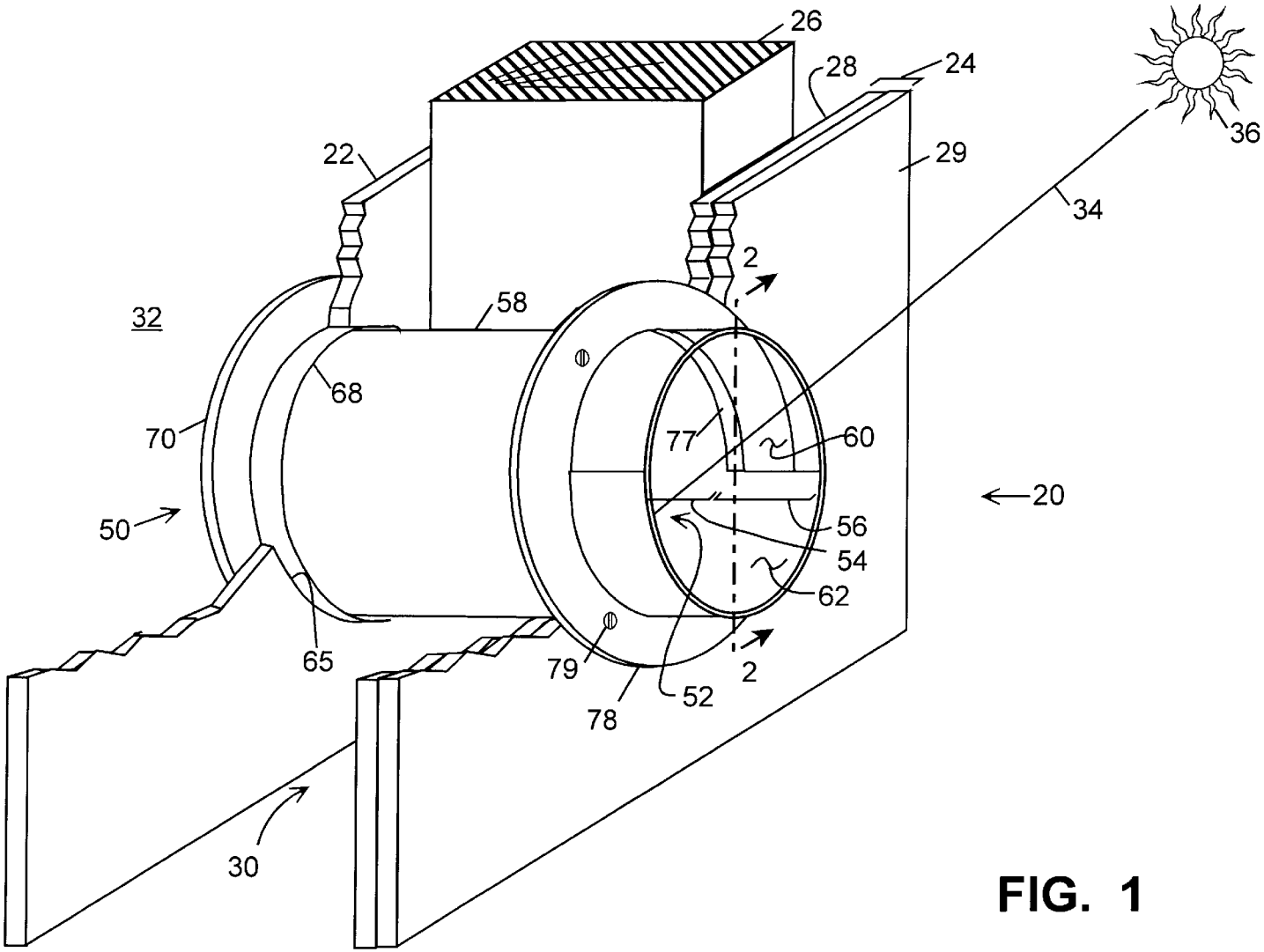
FIG. 1 is a cut away, perspective view of the lighting system.
Figure 2:
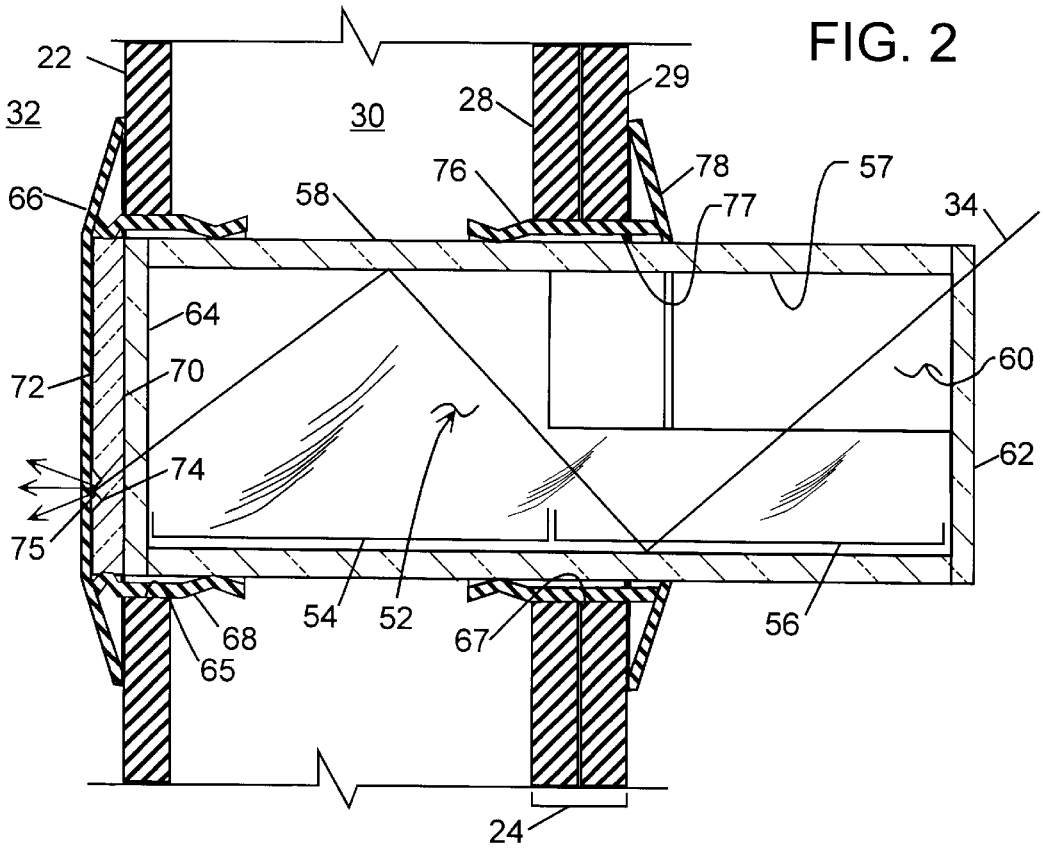
FIG. 2 is a cross-section of the light system taken along line 2—2 of FIG. 1.

Referring in detail to the drawings wherein similar parts of the invention are identified by like reference numerals, and more particularly to FIGS. 1 and 2, a wall 20 of a stick or balloon framed structure typically comprises an inner wall 22 and an outer wall 24 (indicated by a bracket) separated by a plurality of spaced apart studs 26 that stretch from floor to ceiling. The inner wall 22 may comprise a layer of sheet rock which is painted or covered with a decorative wall covering, tile, or a layer of plaster. The inner wall 22 may also comprise a layer of wood or metal lath covered with plaster. On the other hand, the inner wall 22 may comprise wood paneling or another covering for the studs. The exterior wall 24 typically comprises a layer of sheeting 28 covered by layer of siding 29 or a brick or stone veneer. A moisture barrier (not illustrated) may separate the outer wall from the inner wall. The space 30 between the inner 22 and outer 24 walls may be empty or filled with insulation.

The lighting system 50 comprises generally, an internally reflecting, curved planar mirror or reflector 52 that extends from a first end exposed to the interior space 32 to a second end projecting from the siding 29 on the outside of a wall 20. A length (indicated by a bracket) of the mirror 52 proximate the interior space or light sink space 32 and extending substantially through the wall 20 comprises a closed curve, planar mirror 54. Light 34 impinging on the mirror 52 is concentrated and reflected repeatedly from the closed curved reflecting surface 54 of the mirror until the light reaches the light sink space 32. Typically, the lighting system 50 is installed in an exterior wall of a building with the sun 36 providing a source of light 34 for an interior space. However, the lighting system 50 can be installed in an interior wall to transfer light from one interior space having a source of natural or artificial light to another interior space.

In addition to the closed curve planar length 54 of the mirror 52 that passes through the wall 20, the mirror includes a second length of open curve, planar reflecting surface 56 (indicated by a bracket) that projects from the outer surface of the wall 20. The projecting, open curve length 56 of the mirror 52 concentrates light from the source and increases amount of light captured by the lighting system 50.

The curved planar mirror 54 is conveniently constructed by depositing a reflective coating or film on the internal surface 57 defining the aperture in a hollow, transparent tube 58. Coating the full circumference of the internal surface 57 produces the length of closed curve reflecting surface 54 of the mirror 52. In the projecting portion of the tube 58, an arc less than the circumference of the inner surface 57 is reflectively treated producing the length of open curve reflecting surface 56 of the mirror 52 and leaving a transparent window 60 in an upper segment of the tube 58 for light to enter the tube. Transparent caps 62, 64 are glued to the ends of the tube 58 and the tube can be filled with dry gas and sealed to prevent the ingress of moisture and reduce convective and conductive heat transfer. Light 34 from the source 36 can enter the tube 58 through the transparent outer end cap 62 and the window 60 comprising the uncoated segment of the circumference of the internal surface 57 of the transparent tube 58 and is concentrated by the curved mirror 52. As a result, substantially more light is captured and transmitted by the lighting system that would be transmitted a window of comparable area. This reduces the complexity and cost of construction and improves the thermal efficiency over a window. The light 34 is reflected by the open curve length 56 of the mirror 52 onto the closed curve length 54 and thence through the wall 20 of the structure into the light sink space 32. The tube 58 may comprise any transparent material such as glass or ultraviolet light (UV) stabilized, acrylic plastic. While tubing of circular cross-section is readily available and facilitates convenient installation, tubing of any cross-section, for example an elliptical cross-section, can be used.

Figure 3:
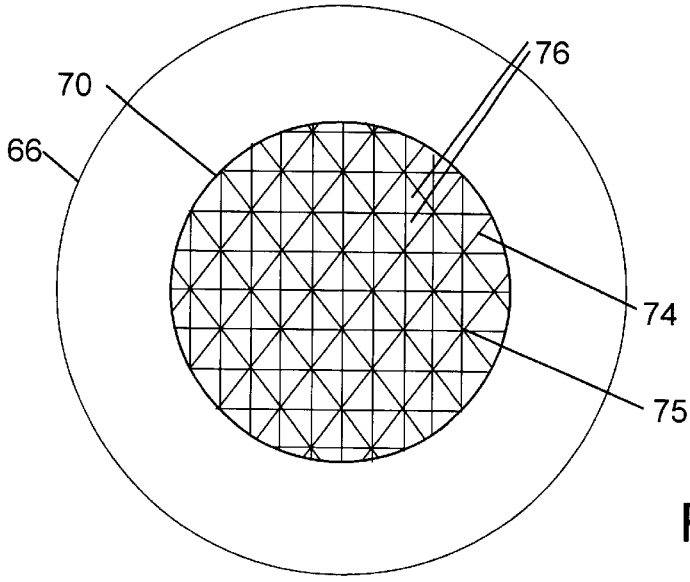
FIG. 3 is an end view of the lighting system from an interior space.

To install the lighting system 50 in a stick framed wall 20, a space for the mirror between the vertical studs 26 is located. Apertures 65, 67 for the tube 58 are cut in the inner 22 and outer 24 walls. The end of the tube 58 proximate to the light sink space 32 is restrained in an inner trim ring 66 by a collar 68 that projects from the trim ring to encircle the tube. The collar 68 may be formed to grip or clamp the tube 58 and the trim ring 66 may be restrained to the inner wall 22 by interference between the collar 68 and aperture 65 in the inner wall or by screws (not illustrated) or other fasteners. The inner trim ring 66 also restrains a diffuser 70 so that the diffuser is trapped between the end of the tube 58 and the trim ring and covers the end of the mirror 52. The diffuser 70 diffuses the light passing through the lighting system 50 for more even illumination and enhances the privacy of the occupants of the space 32. Referring to FIG. 3, typically, the diffuser 70 comprises glass or plastic disk having a surface 72 that causes light 34 passing through the disk to exit at a plurality of angles to the plane of the disk. For example, the diffuser 70 includes a surface including a plurality criss-crossing of V-shaped grooves 74. The crisscrossing grooves 74 produce a surface 72 comprising a plurality of pyramidal protrusions. Each of the protrusions has a plurality of facets 76 which cause the light exiting the surface to be bent to several exit angles. As illustrated, the diffuser 70 is a separate element. However, the inner end cap 64 of the tube 58 can be made from material having the light diffusing surface, eliminating the separate diffuser.

The end of the tube 58 proximate to the outer wall 24 is inserted into an aperture formed by a collar 76 attached to an outer trim ring 78. The trim ring 78 is slid over the tube 58 into contact with outer surface of wall 20. The collar 76 may be sprung to grip or clamp the outer diameter of the tube 58. The outer trim ring 78 may be restrained to the outer wall by interference between the collar 76 and the edge of the aperture in the outer wall 24 or by screws 79 or other fasteners. The circumferences of the trim ring 78 and the aperture in the trim ring are typically caulked to prevent infiltration of moisture and air completing the installation. Because the lighting system 50 is installed on a vertical wall 20 caulking is effective in promoting a leak free installation.

Stick framed walls are commonly constructed with 2×4, 2×6, or metric sized studs and may be covered by a variety of surfaces of varying thickness. Likewise, masonry walls and walls of other construction vary in thickness. The lighting system 50 can accommodate walls of varying thickness with tubes 58 of differing lengths and by permitting a greater or lesser length of the tube to project from the outside of the wall 20. To maintain the efficiency of the lighting system 50 in the event that the thickness of the wall is such that the open curve length 56 of the mirror 52 terminates in the interior of the wall, the internal surface 77 of the collar 76 is reflective. Light that might otherwise escape from the internally reflecting mirror 52 through portion of the transparent window 60 inside the wall 20 is reflected back into the tube by the reflecting surface 77 of the collar 76.

Since the lighting system is compact, the system may be installed in the spaces between studs without the necessity of special framing. While installation is illustrated for a stick-framed wall, the lighting system can be installed in walls of other construction, such as concrete or concrete block, by similar methods if the wall includes an area large enough for the aperture for the tube 58.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A lighting system comprising an internally reflecting curved planar mirror having a length defined by a first end proximate a light sink and a second end proximate a light source, said curved planar mirror comprising a closed curve reflecting surface for a first length proximate said first end and an open curve reflecting surface for a second length proximate said second end.

2. The lighting system of claim 1 wherein said first length of said curved planar mirror extends from said first end substantially through a wall separating said light source and said light sink.

3. The lighting system of claim 2 wherein said wall is substantially vertical.

4. The lighting system of claim 1 wherein said internally reflecting curved planar mirror comprises a tube having an outer surface and an internal surface, said internal surface having a circumference defining an aperture, said circumference of said internal surface being reflective for said first length and an arc less than said circumference being reflective for said second length.

5. The lighting system of claim 4 further comprising a collar having an internal surface defining an aperture with a circumference adapted to encompass said outer surface of said tube, said internal surface being reflective over at least part of said circumference.

6. The lighting system of claim 4 further comprising:

(a) a first transparent cap closing said aperture of said tube at said first end, and (b) a second transparent cap closing said aperture at said second end.

7. The lighting system of claim 6 wherein said first transparent cap comprises a surface including a feature diffusing light transmitted through said cap.

8. The lighting system of claim 1 further comprising a light diffuser disposed between said first end of said mirror and said light sink.

9. The lighting system of claim 1 wherein said closed curve reflecting surface is circular in cross-section.

10. A lighting system to transfer light from a first side of a wall to a space to be illuminated on a second side of said wall, said lighting system comprising:

(a) a tube having an external surface and an internal surface, said internal surface having a circumference defining an aperture and a length defined by a second end proximate to said second side of said wall and a first end spaced outward from said first side of said wall, said circumference being reflective for a first mirror length extending substantially from said second end of said tube into said wall to an end of said first mirror length and an arc of said circumference being reflective for a second mirror length extending from said end of said first mirror length to said first end of said tube; and (b) a diffuser substantially coextensive with said aperture and disposed between said internal surface and said space to be lighted.

11. The lighting system of claim 10 wherein said tube comprises a transparent closed curved plane.

12. The lighting system of claim 11 wherein said closed curved plane is circular in cross-section.

13. The lighting system of claim 10 further comprising a collar having an internal surface defining an aperture with a circumference adapted to encompass said external surface of said tube, said internal surface of said collar being reflective over at least part of said circumference.

14. The lighting system of claim 10 further comprising:

(a) a first transparent cap closing said aperture in said first end of said tube; and (b) a second transparent cap closing said aperture in said second end of said tube.

15. The lighting system of claim 14 wherein said diffuser comprises a surface of said second cap, said surface comprising a plurality of faceted protrusions.

16. The lighting system of claim 10 wherein said tube comprises acrylic plastic.

17. A method of lighting an interior space of a structure, said method comprising the steps of:

(a) cutting an aperture in a wall separating said interior space from a source of light, said wall including an inner surface defining said interior space and an outer surface proximate said source;

(b) extending an internally reflecting mirror through said wall, said mirror having a second end spaced outward from said outer surface of said wall and a first end proximate to said inner surface; said mirror including a first closed curve planar length extending at least substantially through said wall from said first end and an open curve planar length extending proximate said second end;

(c) restraining said first end of said mirror to said inner surface of said wall;

(d) slidably engaging said mirror with an outer restraint; and (e) restraining said outer restraint to said mirror and said outer surface of said wall.

18. The method of claim 17 further comprising the step of affixing a diffuser between said mirror and said interior space.

19. The method of claim 17 further comprising the steps of enclosing said first and said second ends of said mirror.

20. The method of claim 17 further comprising the step of slidably engaging said mirror with a collar having an internal surface adapted to encompass said mirror, said internal surface being reflective.

* * * * *